United States Patent [19]

McKelvey

[11] 4,216,665

[45] Aug. 12, 1980

[54] PORTABLE SKI/POLE LOCK AND CARRYING APPARATUS

[76] Inventor: Kay McKelvey, 1419 N. 15th St., Boise, Id.

[21] Appl. No.: 924,503

[22] Filed: Jul. 14, 1978

[51] Int. Cl.[2] ..... E05B 73/00

[52] U.S. Cl. ..... 70/58

[58] Field of Search ..... 70/14, 15, 18, 57, 58, 70/225, 226, 227, 233; 280/11.37 C, 11.37 K, 11.37 A; 211/605 K; 224/5 Z, 455

[56] References Cited

U.S. PATENT DOCUMENTS

| | | | |
|---|---|---|---|
| 3,838,585 | 10/1974 | Foote | 70/18 |
| 4,059;209 | 11/1977 | Grisel | 224/455 |

FOREIGN PATENT DOCUMENTS

| | | | |
|---|---|---|---|
| 2334387 | 7/1977 | France | 70/58 |

*Primary Examiner*—Robert L. Wolfe

*Attorney, Agent, or Firm*—Paul F. Horton

[57] ABSTRACT

Ski/Pole lock and carrying apparatus, foldable, and adapted to be carried in a pocket. The apparatus includes a pair of ski-clamping members connected together by a hinge; a pair of pole clamping members; a second pair of hinges connecting each of the pole clamping members to a ski-clamping member at an end opposite to and transverse to the first hinge; and a locking means for holding the members in a releasably closed position.

2 Claims, 4 Drawing Figures

PORTABLE SKI/POLE LOCK AND CARRYING APPARATUS

BACKGROUND OF THE INVENTION

1. Field of the Invention

This invention relates, in general, to ski and skipole securing and carrying devices, and in particular, to ski/pole lock devices which may be folded to be carried in the pocket of the skier during non-use.

2. Description of the Prior Art

Problems associated with hand transport of skiing equipment without a lock and carrier have long been recognized in the art. The equipment is awkward to carry and separation and subsequent loss of equipment is all too common. In addition, cost of ski equipment has soared and theft is now a major problem.

To prevent loss of equipment, many devices have been developed for securing and carrying skis and poles as typified by U.S. Pat. Nos. 3,892,343; 3,999,655; 3,985,275, and 4,057,983. While securing the skis and poles, such devices are not largely used because of their size and bulkiness. The skier who is on the slopes and using the equipment is faced with the further problem of storing the ski carrier to prevent its loss by theft or misplacement. It would therefore be an improvement in the art to provide a ski/pole lock/carrier which may be folded for placement in the pocket during skiing.

SUMMARY OF THE INVENTION

The present invention is a lock system and can also be used as a carrier for a pair of skis and ski poles. The invention includes a ski clamp and a ski-pole clamp hingeably engaging the ski clamp and operable to open in unison with the ski clamp; the pole clamp being adapted to fold back onto the ski clamp during non-use for convenient pocket storage. A more comprehensive description of the apparatus may be found in the appended claims.

It is therefore a primary object of the present invention to provide a ski and pole lock and carrying apparatus which is foldable for pocket insertion.

It is a further object of the present invention to provide a carrier for skis and poles which may be opened and closed as a unit and which is foldable for pocket insertion.

Additional objects and advantages will become apparent and a more thorough and comprehensive understanding may be had from the following description taken in conjunction with the accompanying drawings forming a part of the specification.

DETAILED DESCRIPTION OF THE INVENTION

Figure 1:
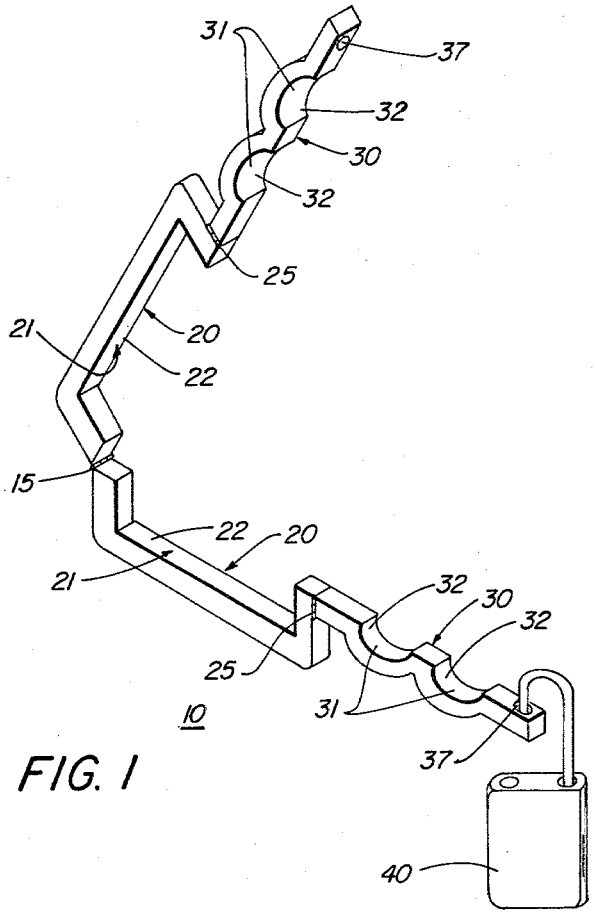
FIG. 1 is a perspective view showing the apparatus in a ski and pole receiving position.
Figure 2:
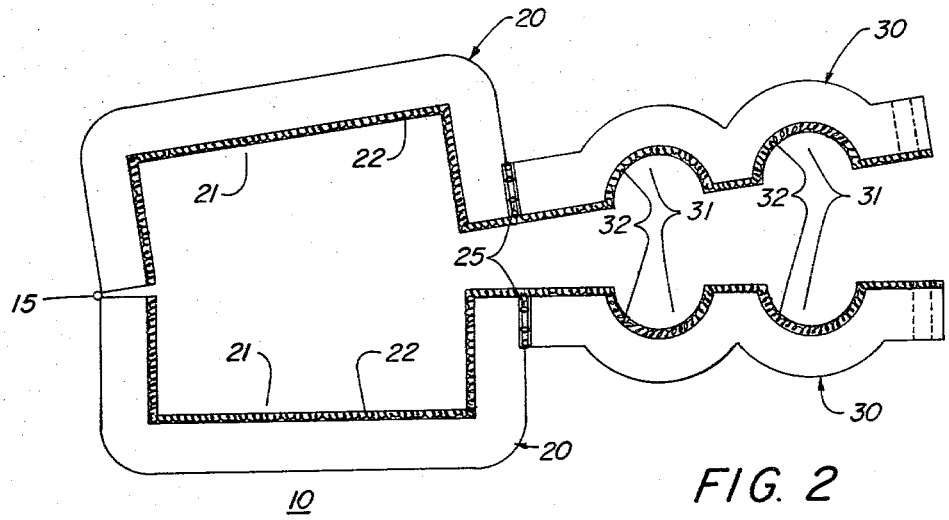
FIG. 2 is a plan view of the apparatus of FIG. 1 shown in an open position.

Referring now to the drawings, and more particularly to FIG. 1 and 2, an embodiment to be preferred of ski and pole securing and carrying apparatus 10, made according to the present invention is disclosed. Ski/pole lock and carrier 10 includes a pair of of oppositely disposed ski-clamping members 20 and a pair of oppositely disposed pole clamping members 30.

Each ski-clamping member 20 defines a recess 21, rectangular in cross section, and adapted to receive a pair of skis. Ski-clamping members 20 are inter-connected at one end by means of hinge 15 to provide lateral registry between recesses 21. Clamping members 20 may be constructed of plastic, metal, or other suitable materials. A resilient lining 22 may be provided to prevent abrasion of the skis in their contact with the recesses, and to provide a cushioned non-slipping surface for skis which may vary slightly in size. Lining 22 may be manufactured of plastics, rubber, or other materials conventionally used for such purpose.

Pole clamping members 30 are each connected by means of hinge 25 to one of the ski clamping members 20 at an end opposite hinge 15. Hinges 25 are mounted at right angles to hinge 15 to permit folding of pole clamping members 30 back on to the top of ski-clamping members 20. Clamping members 30 are so attached as to provide lateral registry between pole receiving recesses 31, defined by members 30. Pole clamping members 30 are preferably identical in length to ski holding members 20 to prevent overlap when the pole members are folded on to the ski members 30, shown to advantage in FIG. 3. It is preferred that recesses 31 have a resilient lining 32 similar or identical to lining 22 of recesses 21 and for the same purpose.

Each pole clamping member 30 contains adjacent its terminal free end, an aperture 37 for insertion of lock 40 to retain the members in a closed position. It is contemplated that other conventional locking devices may similarly be used.

Figure 3:
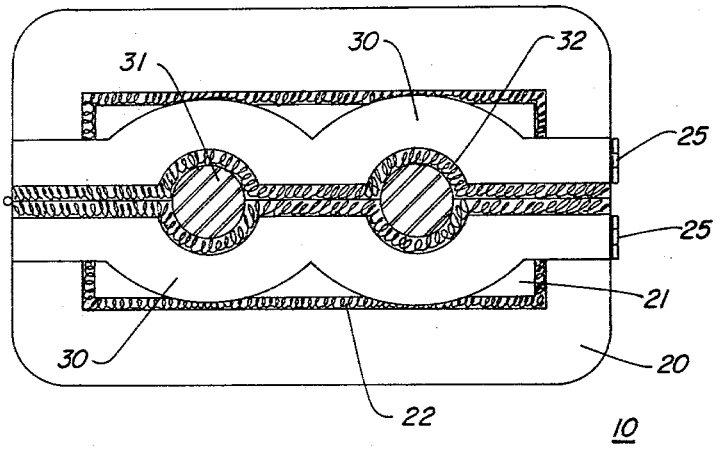
FIG. 3 is a plan view of the apparatus of FIG. 1 shown in the folded position.
Figure 4:
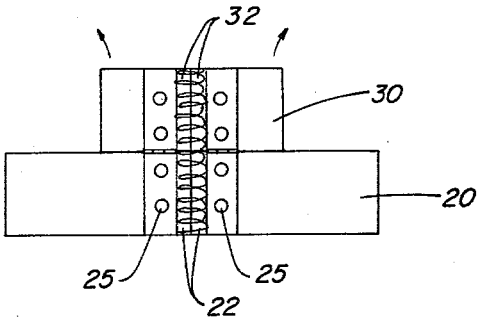
FIG. 4 is a back view of one embodiment of the present invention shown in the folded position.

Preferred dimensions of apparatus 10 in the closed position is a combined exterior length of 4" for both ski clamps and pole clamps; a combined exterior width of $2\frac{3}{4}$" for the ski clamps and somewhat less for the pole clamps and a depth of $\frac{1}{2}$" for both ski and pole clamps or, when in the folded position, as shown in FIG. 3, a combined depth of 1". Total exterior dimensions, then, for the folded device is $4'' \times 2\frac{3}{4}'' \times 1''$, providing easy insertion into standard size pockets.

In operation, the folded apparatus 10, as shown in FIG. 3, is taken from the pocket and unfolded to the rectilinear position as shown in FIGS. 1 and 2. This is accomplished by simply grasping the free end of each member 30 and pivoting it in relationship to each member 20 by means of hinge 25, until the hinged end of member 30 abuts the end of member 20. Once in the rectilinear position, apparatus 10 is opened by spreading members 30 laterally in opposing directions by means of hinge 15. It is to be noted that ski-clamping members 20 open in unison with pole clamping members 30 as they pivot about hinge 15. This is so because hinges 25 are mounted in transverse orientation to hinge 15 and both hinge 15 and hinges 25 are operable to rotate in but one plane. Once opened, skis, with their flat under surfaces placed together, are inserted into recesses 21 and poles are placed into recesses 31 and the apparatus is closed by bringing the opposing members together thereby clamping the skis and poles in place. Apparatus 10 is held in the closed position by lock 40 or other similar device. When use of the equipment is to be resumed, the process is simply reversed.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. Portable apparatus for securing and carrying a pair of skis and poles comprising:

a first clamping means having opposing members operable to receive a pair of skis;

a first hinge means connecting each of said opposing members at one end thereof;

a second clamping means having opposing members operable to receive a pair of ski poles;

a second pair of hinge means, each of said second hinge means connecting one end of said opposing members of said second clamping means to one end of each of said opposing members of said first clamping means at an end opposite said first hinge means, each of said second pair of hinges transversely oriented to said first hinge means; and locking means disposed on the apparatus for releasably holding said members in a closed position.

2. Portable apparatus for securing and carrying a pair of skis and poles comprising;

a first pair of oppositely disposed clamping members, each of said members having wall portions defining an inwardly opening recess in lateral registry with a recess of an opposing member, said recesses operable to receive and hold a pair of skis;

a first hinge connecting said first pair of members at one end to permit pivotal movement in a horizontal plane between said first members for retention and removal of the skis and poles;

a second pair of oppositely disposed clamping members, each of said members having a wall portion defining a first and second, inwardly opening recess longitudinally spaced from one another, each of said first and second recesses in lateral registry with opposing first and second recesses of opposing members, said first and second recesses operable to receive and hold a ski pole;

a pair of second hinges, each of said second hinges connected to one of said first pair of clamping members at an end opposite said first hinge and connected to one of said second clamping members at one end thereof, said second hinges transversely oriented in relationship to said first hinge to permit pivotal movement in a vertical plane between said first members and said second members; and locking means disposed on the apparatus for releasably holding said members in a closed position.

* * * * *